United States Patent [19]

Meisner

[11] Patent Number: 4,769,556

[45] Date of Patent: Sep. 6, 1988

[54] ELECTRONIC CLOCK TIMER FOR A KITCHEN RANGE

[75] Inventor: Alfred Meisner, Nuremberg, Fed. Rep. of Germany

[73] Assignee: Diehl GmbH & Co., Nuremberg, Fed. Rep. of Germany

[21] Appl. No.: 128,151

[22] Filed: Dec. 3, 1987

[30] Foreign Application Priority Data

Dec. 18, 1986 [DE] Fed. Rep. of Germany ..... 3643260

[51] Int. Cl.[4] ..... H01H 3/34; H05B 1/02

[52] U.S. Cl. ..... 307/141.8; 219/492; 368/108

[58] Field of Search ..... 368/107–112; 307/141–141.8; 219/10.5 BB, 492, 493, 494, 501, 507, 508

[56] References Cited

U.S. PATENT DOCUMENTS 4,266,118 5/1981 Takase et al. ..... 219/492

4,713,528 12/1987 Hirata ..... 219/493

*Primary Examiner*—Vit W. Miska

*Attorney, Agent, or Firm*—Scully, Scott, Murphy & Presser

[57] ABSTRACT

An electronic clock timer for a kitchen range; in which the timer includes a control circuit, a display area, with entry elements and with a switch arranged in the control circuit, through which the appliance or electrical consumer which is controlled by the timer through a power switch, can be switched over from manual operation to automatic operation upon the digital entry of at least one complete switching or operating cycle. The power switch and the electrical consumer are electrically connected in series with a selector switch arranged on the consumer for preselection of the power supply to the latter; and with a component being associated with the power switch, which detects the opened or closed condition of the switch in such a manner that a signal is transmitted from this component to a control switching circuit when, at an already opened power switch, there is also opened the selector switch and that as a result thereof there is effectuated in the control switching circuit a switchover from automatic to manual operation.

4 Claims, 1 Drawing Sheet

ELECTRONIC CLOCK TIMER FOR A KITCHEN RANGE

BACKGROUND OF THE INVENTION

1. Field of the invention

The present invention relates to an electronic clock timer for a kitchen range; in which the timer includes a control circuit, a display area, with entry elements and with a switch arranged in the control circuit, through which the appliance or electrical consumer which is controlled by the timer through a power switch, can be switched over from manual operation to automatic operation upon the digital entry of at least one complete switching or operating cycle.

2. Discussion of the Prior Art

An electronic timer of the type under consideration, such as a kitchen range timer, is disclosed in German Laid-Open Patent Appln. No. 33 20 128. In that instance, upon the input of a complete switching cycle through the input or entry elements for the digital display in the timer, there is effectuated a switchover from manual operation; in effect, from the normal mode of operation of the timer to automatic operation. After completion of the operating or switching cycle, one of the selector switches for the electrical consumer; for instance, the knob for the burner control, on the one hand, must be reset to zero and on the clock itself there must be carried out a resetting from automatic to manual operation. When, because of an inadvertence, the selector switch is not reset, then the electrical consumer will be again supplied with current during the resetting of the timer from automatic to manual operation, without this being desired by the user.

Furthermore, in connection with timers which are installed in electric ranges, it is in general quite usual, that the power switch for the electrical consumer which is controlled by the timer, is connected in series with the selector switch; for instance, the knob for the burner control.

SUMMARY OF THE INVENTION

Accordingly, commencing from the above-mentioned state-of-the-art, an object of the present invention contemplates a simplification of a kitchen range timer, in which there is eliminated the hand-operated selector switch for switching between manual and automatic operation, while concurrently there is improved the safety of operation of the range timer.

In order to attain the foregoing object, the invention provides for the power switch and the electrical consumer being electrically connected in series with a selector switch arranged on the consumer for preselection of the power supply to the latter; and with a component being associated with the power switch, which detects the opened or closed condition of the switch in such a manner that a signal is transmitted from this component to a control switching circuit when, at an already opened power switch, there is also opened the selector switch and that as a result thereof there is effectuated in the control switching circuit a switchover from automatic to manual operation.

Thus, in principle, the present invention commences from the determination, on the one hand, as to whether the power switch for the electrical consumer is again open after passing through the operating cycle, and whether the selector switch has been reset to zero. As soon as the last-mentioned is the case, a signal is transmitted to the control switching circuit for the timer which resets the timer from automatic to manual operation. However, when in contrast therewith, the selector switch has not been reset to zero, then the timer remains on automatic operation, and the electric consumer cannot be undesirably resupplied with electrical current; in this instance, a supplying with electrical current is only possible upon a new entry of a cooking term. This arrangement results in the elimination of the need for a mechanical selector switch for manual operation and automatic operation, and affords the further advantage that, in case of an incorrect actuation, the electrical consumer is not supplied with current.

In accordance with the invention, it is especially advantageous that the component which serves for the detection of the switching position of the power switch need merely be a high-ohmic resistance or impedance.

BRIEF DESCRIPTION OF THE DRAWINGS

Reference may now be had to the following detailed description of a preferred embodiment of the invention, taken in conjunction with the accompanying drawings; in which.

DETAILED DESCRIPTION

Figure 1:
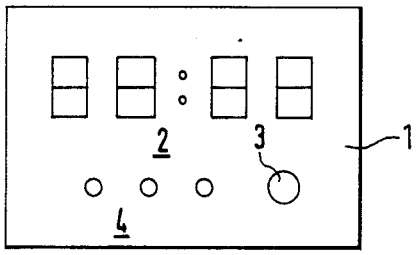
FIG. 1 illustrates a front view of an electronic kitchen range timer with a display and actuating elements.

Illustrated in FIG. 1 is a front elevational view of a kitchen range timer 1, in which there can be ascertained a digital display 2 for displaying the minutes and hours. Moreover, a turning knob 3 is provided for the setting of the digital display, and function keys 4 or buttons through which a selection can be made as to whether there is to be entered a cooking period or the end of the cooking time, or a short cycle.

Figure 2:
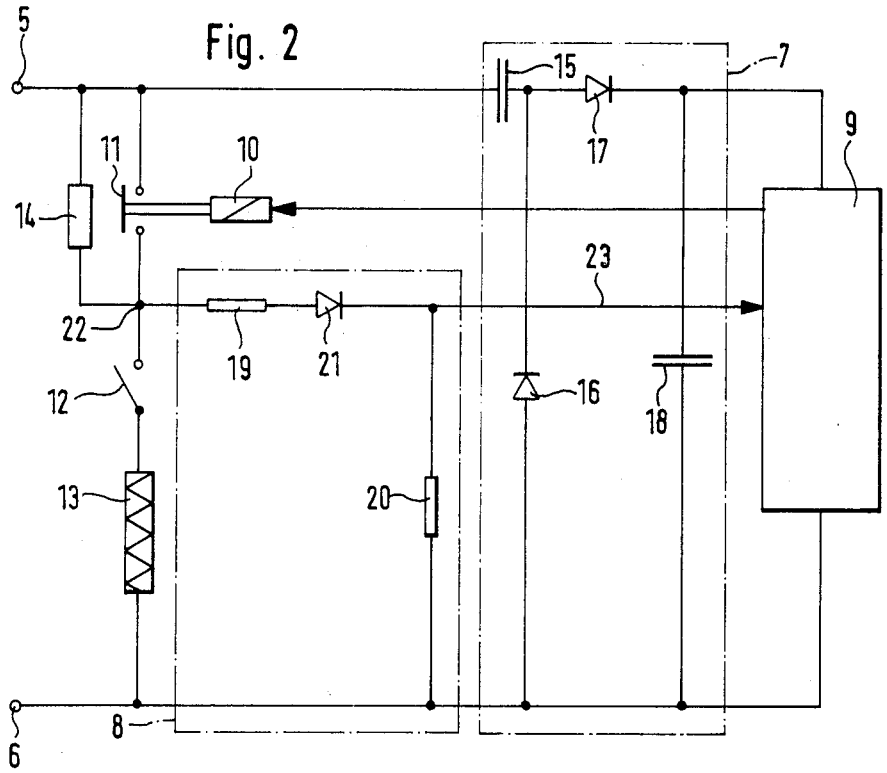
FIG. 2 illustrates a block circuit diagram of the invention.

An electronic switching arrangement is illustrated in FIG. 2, which serves for the realization of the invention and, which, except for the selector switch and the electrical consumer, is built into the timer. Provided at two poles 5 and 6 of the power supply lines are a power supply 7, a level correlating arrangement 8, a control circuit 9, a power switch 11 which is actuated from a relay 10, a selector switch 12 and an electrical consumer 13, as well as a high-ohmic resistance or impedance 14.

The power supply 7 is conventionally constructed and contains a capacitance or condenser 15 for reducing the power supply voltage, a zener diode 16 for stabilization, and a diode 17 as well as a capacitance 18 for rectifing the voltage for the control circuit 9, which is preferably a microprocessor and controls the entire operation of the clock or timer.

The circuit 8 for level correlation encrmpasses two impedances or resistances 19 and 20, as well as a diode 21, and serves merely for the purpose of creating a suitable input level for the control circuit 9, commencing from the switching point 22. The line conducting the signal between this circuit 8 and the control circuit 9 is identified by the reference numeral 23.

Depending upon the entered operating terms, a relay 10 is either actuated or deactivated by the control circuit 9, which relay actuates the power switch 11 in the control circuit of the electrical consumer. For example, this consumer 13 is a rangetop cooking plate or the baking conduits of an electric range. The power supply to the electrical consumer can be adjusted in a plurality of steps by the operation of the selector switch 12.

The high-ohmic impedance or resistance 14 between the circuit point 22 and the pole 5 of the power supply voltage serves for bypassing or shunting across the power switch 11 and, within the context of the invention, is important for the detection of its switching position; in essence, as to whether it is open or closed. When the selector switch 12 and the power switch 11 are closed, with the assumption that a high potential is present at the pole 5, then the potential at circuit point 22 is also high. When the selector switch 12 is closed but, in contrast therewith, the power switch 11 is open, then the potential at circuit point 22 is low; when the selector switch 12 and power switch 11 are both open, then the potential at this circuit point is zero.

Commencing from these conditions, the circuit arrangement operates generally as follows:

In the normal instance, the timer is set on manual operation; in essence, the electrical consumer 13 can be directly actuated by the setting of the selector switch, and can be operated with the selected or set power step. Hereby, the power switch 11 is closed. When an operating cycle; for example, such as a cooking time of three hours as well as a cooking time end is introduced through the function buttons 4 and the turning knob 3, in which the cooking end time is more than three hours later than the actual time, then the power switch 11 is opened by the control circuit 9. However, the user will already set the anticipated cooking cycle at the selector switch at the actual timepoint. Nevertheless, because the power switch 11 is open, the cooking cycle cannot yet start.

As soon as the commencement of the cooking time which is calculated by the control circuit coincides with the actual or present time, the power switch 11 is closed and the electrical consumer is supplied with current in conformance with the step set at the selector switch 12. At this point in time, the initially low potential at the circuit point 22 is raised to the high potential of the pole 5.

At the end of the cooking cycle, the power switch 11 is again opened by the control circuit 9. The selector switch 12 still remains closed. The potential at circuit point 22 is again reduced to its lower value. Hoever, the control circuit 9 does not receive a signal and the clock or timer remains switched to automatic operation. The electrical consumer cannot be again supplied with current; in the event that the cooking results necessitate an increase in the length of the cooking time; in this case, a new cooking period would have to be entered, without any renewed actuation of the selector switch.

As soon as the user returns the selector switch into the zero position, the potential at circuit point 22 becomes zero and a signal is transmitted to the control circuit through the line 23, which circuit will then internally switch the timer from automatic operation to manual operation; meaning, again close the power switch 11. The timer is thereby again in readiness for operation.

The transference of the potential at circuit point 22 from low to zero potential is thereby evaluated as a criterium as to whether the power switch 11 is open and the selector switch is to be opened. This condition is indicative that an operating cycle has been completed and the timer is to be again switched into manual operation.

What is claimed is:

1. In an electronic kitchen range timer including a control circuit, said timer having a display area, entry elements, and a switch operatively interconnected in the control circuit, an electrical consumer controlled by the timer through a power switch, said timer being switchable by said switch in said control circuit from manual operation to automatic operation upon the digital entry of at least one complete switching cycle into said timer; the improvement comprising: said power switch and said electrical consumer being electrically connected in series with a selector switch arranged on the consumer for the preselected of the power supply to the consumer; a component being operatively connected with the power switch for detecting the open or closed condition of said power switch, a signal being transmitted from said component to the control circuit upon opening of the selector switch at an already open condition of the power switch, so as to effect a switching over from automatic to manual operation in the control circuit.

2. Electronic range timer as claimed in claim 1, wherein said component is connected between one pole of the power supply and the series circuit comprising the selector switch and the electrical consumer in parallel with the power switch, and wherein the difference in potential at a terminal of the components remote from said pole of the power supply is evaluated in the control circuit between an open and closed selector switch.

3. Electronic range timer as claimed in claim 2, wherein the component is a high-ohmic impedance or resistance.

4. Electronic range timer as claimed in claim 2, wherein a signal line extends between the component and the control circuit, said signal line containing a resistance and a diode for level correlation.

* * * * *